United States Patent [19]

Erickson

[11] 4,269,872

[45] May 26, 1981

[54] METHOD OF PRODUCING AN EROSION RESISTANT SURFACE

[75] Inventor: John W. Erickson, Huntington Beach, Calif.

[73] Assignee: Kobe, Inc., City of Commerce, Calif.

[21] Appl. No.: 134,049

[22] Filed: Mar. 26, 1980

Related U.S. Application Data

[62] Division of Ser. No. 50,920, Jun. 21, 1979.

[51] Int. Cl.[3] ..... C23C 13/04

[52] U.S. Cl. ..... 427/239; 427/237; 427/249; 428/163; 428/164

[58] Field of Search ..... 29/156.4 R, 156.4 WL, 29/156.8 R, 156.8 B, 156.8 P; 427/249, 239, 237; 428/601-604, 163, 164, 627, 600; 102/105; 244/117, 121, 123, 126, 160; 138/145, 146; 166/242

[56] References Cited

U.S. PATENT DOCUMENTS

| | | | |
|---|---|---|---|
| 2,993,678 | 7/1961 | Schultz et al. | 428/627 |
| 3,795,494 | 3/1974 | Hordon | 428/627 |
| 3,864,199 | 2/1975 | Meginnis | 428/600 |
| 3,951,612 | 4/1976 | Gates | 428/627 |
| 4,004,615 | 1/1977 | Stern | 428/600 |

*Primary Examiner*—Ralph S. Kendall

*Attorney, Agent, or Firm*—William C. Norvell, Jr.

[57] ABSTRACT

An erosion resistant surface is provided for pump components, valves, fluid conduits, diffusion chambers, fluid cleaners, and the like, wherein the surface is exposed to high velocity flow of a fluid containing abrasive particulates. Sharply increased erosion life of such surfaces can be obtained by providing a plurality of closely spaced depressions in the surface, with each depression having a depth in excess of its width, and then applying an erosion resistant coating to the remaining original surface and all surfaces of the depressions.

6 Claims, 7 Drawing Figures

METHOD OF PRODUCING AN EROSION RESISTANT SURFACE

CROSS-REFERENCE TO RELATED APPLICATION

This Application is a Divisional Application of my co-pending application Ser. No. 50,920, filed June 21, 1979, entitled "Erosion Resistant Surface And Method Of Producing Same".

BACKGROUND OF THE INVENTION

1. Field of the Invention

This invention relates to an erosion resistant surface and a method of producing same and finds particular application in providing increased erosion life for components of hydraulic systems wherein a high velocity fluid containing abrasive particulates is impinged upon or flows along such surface. Surfaces subject to such erosion are found in pumps, valves, conduits, diffusion chambers, fluid cleaners and other forms of hydraulic apparatus.

2. Field of the Invention

In many industrial applications, and particularly in oil well pumping operations, it is necessary to pump, transport and/or clean high velocity fluids containing significant amounts of abrasive particulates. For example, in a typical oil well, the fluid pumped from the well generally contains a significant amount of sand. The surfaces of pumps, valves, conduits, cleaning apparatus and other fluid handling components subjected to the impact of such high velocity fluid, or the surfaces along which the high velocity fluid flows, are subject to relatively fast erosion, resulting in a short useful life of the particular component. Even when such components are fabricated from such highly erosion resistant materials as tungsten carbide or molybdenum, the erosion rate is still far greater than desired.

In recent years, coating materials have been developed for such surfaces which involve relatively expensive metallic alloys which are applied as an integral coating with a thickness typically on the order of 0.001 to 0.002 inches. If the particular component has a surface which can be eroded to a depth of ten thousandths (0.010) inch before having to be discarded, and the erosion resistance of a 0.001 inch coating is ten times that of the base metal, it is readily apparent that the application of the 0.001 inch coating would result in a doubling of the useful life of the component and, while this is desirable, it still does not represent a good return on the increased cost of providing the exotic coating material.

There is, therefore, a distinct need for increasing the erosion resistance of surfaces to high velocity fluids containing abrasive particulates to effect an increase in useful life of the surface by, typically, a factor of four or more.

SUMMARY OF THE INVENTION

This invention provides a method of improving the erosion resistance of a surface by providing in such surface a plurality of closely spaced depressions, with each depression having a depth substantially in excess of the width of the depression. The width of each depression and the separation of the depressions is normally not greater than 0.010 inches. Over the remaining portions of the original surface and on all surfaces of the depressions, an erosion resistant coating is applied with a thickness typically on the order of 0.001 to 0.002 inches.

It has been found that the provision of such depressions, plus the addition of the minimal thickness of a suitable erosion resistant coating results in an increase in the useful life of the treated surface by a factor in excess of four.

By arranging the depressions in certain prescribed patterns, further improvements in the erosion resistance of the resulting surface can be obtained.

Further advantages of this invention will become apparent to those skilled in the art from the following detailed description.

DESCRIPTION OF THE PREFERRED EMBODIMENTS

Figure 1:
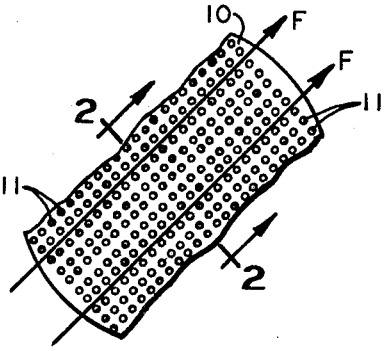
FIG. 1 is an enlarged scale elevational view of a surface portion of a component subject to contact by high velocity fluid flow containing abrasive particulates, which has been modified in accordance with this invention.

Referring to FIG. 1, the numeral 10 represents the surface of a fluid handling component, such as a pump, a valve, a conduit, a diffusion chamber or the like across which there is a flow of high velocity fluid containing abrasive particulates indicated by the arrows F.

Figure 2:
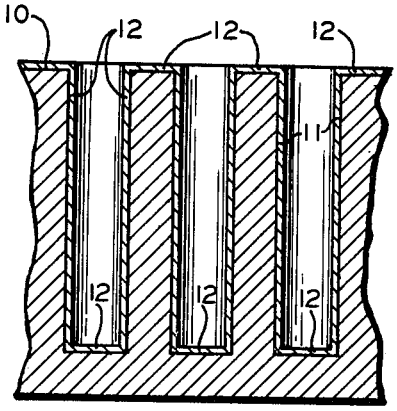
FIG. 2 is an enlarged sectional view of FIG. 1 taken on the plane 2—2 of FIG. 1.

The erosion resistance of the surface 10 can be significantly increased by providing a plurality of closely spaced depressions 11 therein. Each depression 11, here illustrated as cylindrical holes, has a width dimension on the order of 0.004 to 0.010 inches and a depth dimension substantially in excess of the width, ranging from 0.010 to 0.040 inches. Typically, up to one half of the original surface 10 is replaced by the depressions 11. All of the remaining original portions of surface 10, as well as all surfaces of depressions 11, are then provided with an erosion resistant coating 12 having a thickness on the order of 0.001 to 0.002 inches. Preferably the width or diameter of depressions 11 exceeds the thickness of coating 12 by a factor of at least two to four. As shown in FIG. 2, the walls of the depressions 11 are normal to the surface 10, thus defining a plurality of parallel walled columns intermediate the depressions 11 which have their external surfaces defined by erosion resistant coating 12.

In a typical application, such as a surface of a pump component employed for the pumping of oil wells, the basic material forming the surface 11 comprises either tungsten carbide or molybdenum. The erosion resistant coating material can comprise any one of several well known, commercially available coatings selected from the group including silicon nitrides, silicon carbides or titanium diboride.

The combination of the depressions 11 with the relatively thin coating of erosion resistant material results in a minimum of a four-fold increase in the effective erosion resistance and life of the surface. This results first from the fact that the total surface now available to impact by the particulates contained in the fluid flowing past the surface has been increased by an order of magnitude of at least four.

Figure 2A:
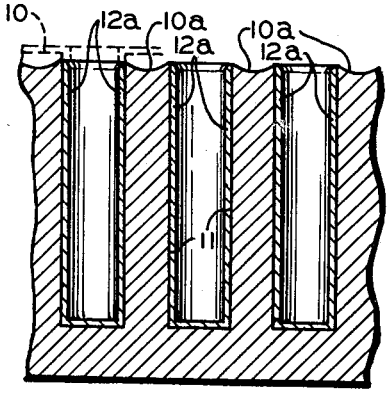
FIG. 2*a* is a view similar to FIG. 2 after initial erosion has occurred.

More importantly, once the erosion resistant coating has been removed from the remaining portions of the original surface 10, that exposed surface will tend to erode more rapidly except for the fact that it is now surrounded by discrete columns of the erosion resistant coating and hence protected to a degree from impact by the particulates. The surface 10 thus assumes the configuration indicated at 10*a* in FIG. 2*a*. Therefore, any significant further erosion of the surface 10*a* can only take place as the columnar elements 12*a* of the coating 12 are worn down.

A simple example will illustrate the effectiveness of the employment of the protective coatings in the described configuration. Assume that the surface 10 can be eroded to a total depth of 0.010 inches before the component has to be replaced. Adding an erosion resistant coating of 0.001 inches to the surface 10 in the manner described will, by itself, provide a doubling of the effective life of the component, assuming the erosion resistant coating has ten times the resistance of the base material of surface 10. Hence, a thickness of such coating one tenth of that of the total allowable erosion depth of the surface 10 will require a time period to erode away equal to the original life of the untreated surface 10. From that point on, however, a substantial further increase in life is obtained because the surface 10 can only be eroded as a function of the erosion of the columnar structures 12*a* provided by the protective coating 12 on the vertical walls of the depressions 11.

Since both sides of columnar structures 12*a* are exposed to erosive effects, let us assume that the effective erosion life is only half of that of the coating when laid down on a supporting surface. If the depressions 11 are 0.010 inches in depth, corresponding to the maximum permissible erosion of surface 10, then the additional ten thousandths of columnar erosion would require a time period of five times the time required to erode 0.010 inches thickness of the original surface 10 or an increased life factor of five times.

In actual practice, the effective erosion life cannot be calculated so simply, as it is a complex phenomenon depending to a large degree on the amount of turbulence existing in the fluid, the velocity of the fluid, the size of the particulates, etc. In any event, it is apparent that an increase in life to a significant degree and, conservatively speaking, at least four times greater than the erosion life of the unprotected surface, will be readily attained.

Figure 3:
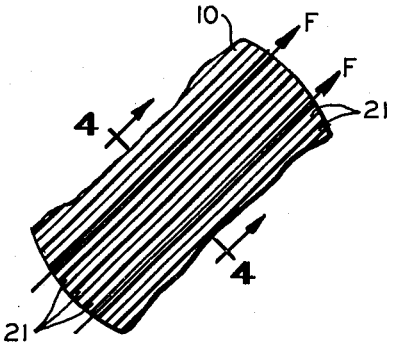
FIG. 3 is a view similar to FIG. 1 of a modified configuration of the depressions formed in the surface to be treated.
Figure 4:
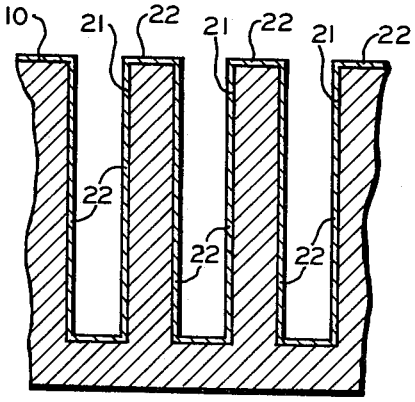
FIG. 4 is an enlarged sectional view taken on the plane 4—4 of FIG. 3.

Referring now to FIGS. 3 and 4, there is shown a modification of this invention wherein the depressions take the form of relatively narrow slots 21 extending generally in the direction of fluid flow relative to the surface 10. The dimensional relationship of the slots 21 is generally the same as that specified for the depressions 11 in the modification of FIGS. 1 and 2, namely, the depth of the slots exceeds the width of the slots by a factor of at least four, and the width of the slots is greater than the thickness of erosion resistant coating 22 by a factor of two to four. A further advantage of the modification of FIGS. 3 and 4 lies in the fact that the particulate containing fluid entering the slots 21 is subjected to laminar flow at lower velocity and hence there is a minimization of the erosion effects of particles which actually impinge against the coated surfaces of the side walls of the slots 21.

Figure 6:
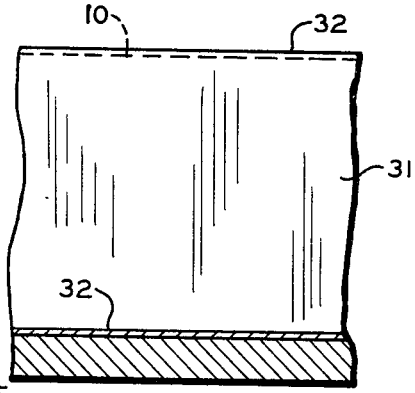
FIG. 6 is an enlarged sectional view taken on the plane 6—6 of FIG. 5.
Figure 5:
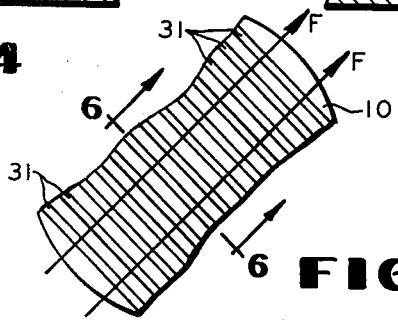
FIG. 5 is a view similar to FIG. 1 of a still further modification of an erosion resistant surface produced in accordance with the method of this invention.

Equally good results as those obtained with the modification of FIGS. 1 and 2 may be obtained with the modification illustrated in FIGS. 5 and 6 wherein the depressions in the surface 10 take the form of slots 31 extending generally transversely to the direction of fluid flow across the surface 10, but having the same dimensional relationship and depth of coating 32 as previously described in connection with the modification of FIGS. 1 and 2.

Other configurations of the depressions will be readily suggested to those skilled in the art but the important consideration is that the depressions provided in the surface to be treated are relatively close together and that the depth of such depressions significantly exceeds the width or smallest dimension of the depressions.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of reducing erosion of a surface subject to contact by a high velocity fluid containing abrasive particulates, comprising the steps of: forming a closely spaced series of depressions in said surface, each said depression having walls normal to the surface and a depth substantially in excess of the width of the depressions; and applying an erosion resistant coating to the remaining portions of said surface and to all surfaces of said depressions, whereby the erosion of the erosion resistant coating from said surface creates a multitude of closely spaced, parallel walled columns having unprotected outer surfaces and side walls of erosion resistant material.

2. The method of claim 1 wherein said depressions are elongated and generally aligned with the direction of fluid flow across said surface.

3. The method of claim 1 wherein said depressions are elongated in a direction generally transverse to the direction of fluid flow across said surface.

4. The method defined in claim 1 wherein said depressions constitute a plurality of closely spaced circular holes.

5. The method defined in claim 1 wherein said surface comprises either a tungsten carbide or molybdenum material and said coating comprises one of the group of erosion resistant coatings including silicon nitrides, silicon carbides and titanium diboride.

6. The method of claim 1 wherein said coating comprises one of the group of erosion resistant coatings including silicon nitrides, silicon carbides and titanium diboride.

* * * * *